United States Patent [19]

Mauer

[11] Patent Number: 4,602,491

[45] Date of Patent: Jul. 29, 1986

[54] COMBINATION LOCK

[75] Inventor: Guenter Mauer, Heiligenhaus, Fed. Rep. of Germany

[73] Assignee: Werner Mauer GmbH & Co. KG, Heiligenhaus, Fed. Rep. of Germany

[21] Appl. No.: 663,446

[22] Filed: Oct. 19, 1984

[30] Foreign Application Priority Data

Oct. 19, 1983 [EP] European Pat. Off. ..... 83110400.5

[51] Int. Cl.[4] ..... E05B 37/12

[52] U.S. Cl. ..... 70/312; 70/306; 70/317

[58] Field of Search ..... 70/312, 315–318, 70/306

[56] References Cited

U.S. PATENT DOCUMENTS

| | | | |
|---|---|---|---|
| 3,411,330 | 11/1968 | Atkinson | 70/315 X |
| 4,198,837 | 4/1980 | Gisiger | 70/312 X |
| 4,249,469 | 2/1981 | Craske | 70/312 X |
| 4,462,232 | 7/1984 | Yang | 70/316 X |

*Primary Examiner*—Robert L. Wolfe
*Assistant Examiner*—Russell W. Illich
*Attorney, Agent, or Firm*—Ralf H. Siegemund

[57] ABSTRACT

The combination lock includes several encoding buttons, a latch plate is slidably movable between two terminal positions and has a plurality of locking pins; a plurality of lock disks each have on one side a radial groove for respectively engaging the locking pins or being disengaged therefrom, each disk further having on its outer side a diametrical groove in which respective slide locks are permitted to slide, an encoding release slide moves said slide locks; a plurality of gears are respectively connected to the encoding buttons and positioned for engagement with the slide locks, the gears are prevented from turning, thereby preventing the encoding buttons from being turned when the respective slide lock engages the gear and the locking pins are situated in the respective radial grooves, the gears are coupled to the lock disks when the locking pins are out of the respective radial grooves, the release slide when moving the slide locks decouples the lock disks from the gears and the encoding button; and resiliently biased tumblers are associated with the gears such that the gears are releasable only in the end positions of said latch plate.

10 Claims, 18 Drawing Figures

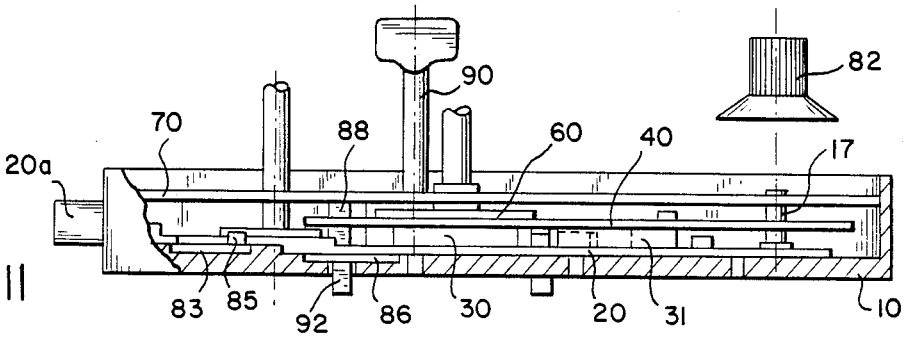
Fig. 11
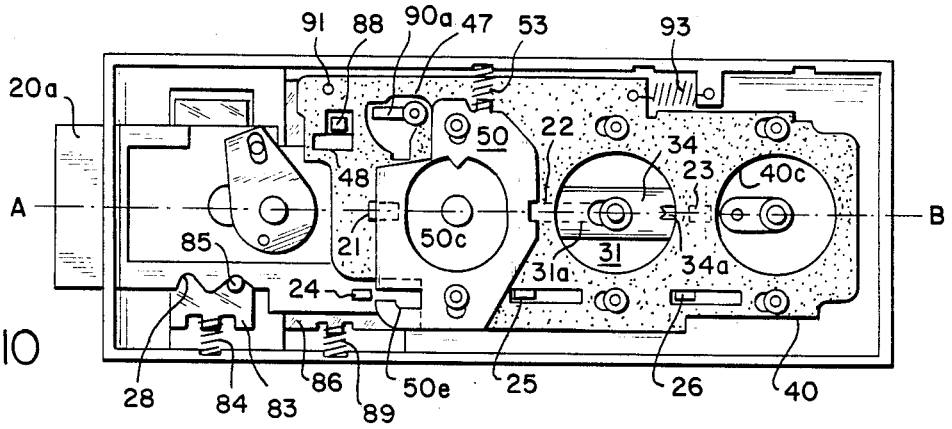
Fig. 10
Fig. 12
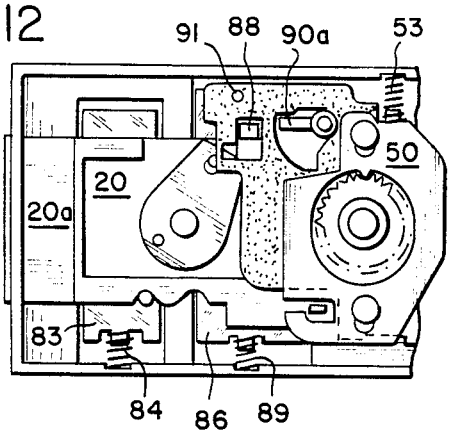
Fig. 13
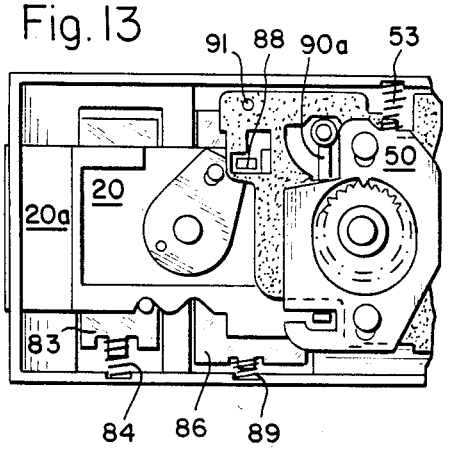
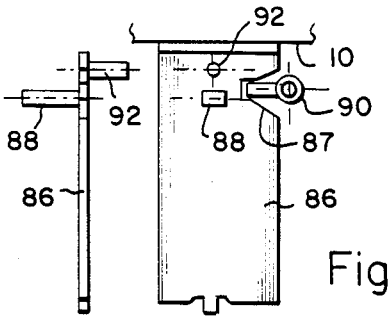
Fig. 16
Fig. 14
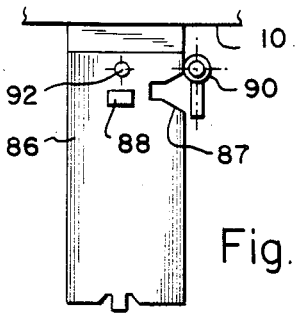
Fig. 15

COMBINATION LOCK

BACKGROUND OF THE INVENTION

The present invention relates to a combination lock with several encoding buttons to be used for locking containers, boxes or the like, and including a latch movable in between two terminal positions; the latch has a plate which carries a particular number of locking pins cooperating with a corresponding number of rotatable locking disks which in turn are controlled by the encoding buttons. Moreover, a common readjustment or encoding release slide is provided for decoupling the encoding buttons and the locking disks.

U.S. Pat. No. 3,053,071 discloses a device for adjusting the locking and opening conditions for a strong box or the like, using permutation locks with several adjustable disks which are associated with axially displaceable locking disks. The engagement of the locking disks with the adjusting disks is releasable for purposes of readjustment towards a different encoding pattern for unlocking. The locking disks are peripherally provided with engagement spaces, which in case of properly adjustment of the device for opening face the scanning or locking fingers of a latching plate. This latching plate is actuated from the outside through a manual device, whereby the scanning or locking finger enters the engagement space of the locking disks. In order to provide for a new encoding, a control plate is provided for being actuated from the outside, and the locking engagement between the locking disks and the adjustment disks can be overcome by means of ball shaped pressure parts.

German Pat. No. 2,918,235 discloses a permutation lock which can be regarded a development arising from the U.S. patent discussed earlier. This permutation lock does not use a control plate provided just for purposes of re-encoding the lock. Rather, the latching plate in the latter patent is constructed so that it does not only provide a scanning function, but also the function of a locking member for purposes of re-encoding. The latching plate is punched in such a manner that in case of an undercut engagement a rather larger areal, crescent shaped, raised locking zone is established. The latching plate moreover is provided with three locking fingers which, in the case of correct positioning, engage the detent or spaces of the three locking disks. Since the axes of the locking disk are arranged along one line, and since the latching plate is pivotable about an axle pin having a particular distance from the aforementioned straight line, it develops that the turning circles of the locking fingers are differently large. In the case of a locked lock, and in case of a slight load on the handle to adjust the trap disk, a locking finger will slide on the locking disk. Thus, with a "fine feel", one can in fact scan the position of the detents. Through repetition of that kind of probing at the next disk, one can in fact lift the secret of the encoding without any damage to the lock, and the lock can thus be opened and reclosed without a trace.

DESCRIPTION OF THE INVENTION

It is an object of the present invention to provide a combination lock for strong boxes, i.e., containers for valuables such as safes in a hotel, safety boxes in banks or the like, and meeting high demands as to quality and security, with particular emphasis on safety against trial and error attempts to open the lock, while the user and owner of the facility can change the combination at any time, and in a very simple manner.

In accordance with the preferred embodiment of the present invention, it is suggested to improve combination locks of the type outlined above by providing each locking disk on the side facing the respective latch plate with a radial slot facing a pin on the latch plate; moreover, each locking disk is provided on the opposite side with a diagonal or diametrical groove carrying a locking slide, all of which are guided by an adjustment slide and engages a gear connected with an encoding button; moreover, each gear is associated with a resiliently biased tumbler which will be released only in the terminal position of the lock.

DESCRIPTION OF THE DRAWING

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

FIG. 10 is a top view into the lock box with extended latching plate and additional detail;

FIG. 11 is a partial section and side view of the arrangement shown in FIG. 10;

FIGS. 12 and 13 are two side views of an inserted latch plate, the figures differ by the position of the encoding release slide;

FIGS. 14 and 15 illustrate two different possible positions of a control slide as controlled through an adjusting key being visible in part but partially covered in FIGS. 12 and 13;

FIG. 16 is a side view of the control slide shown in FIGS. 14 and 15.

Figure 1:
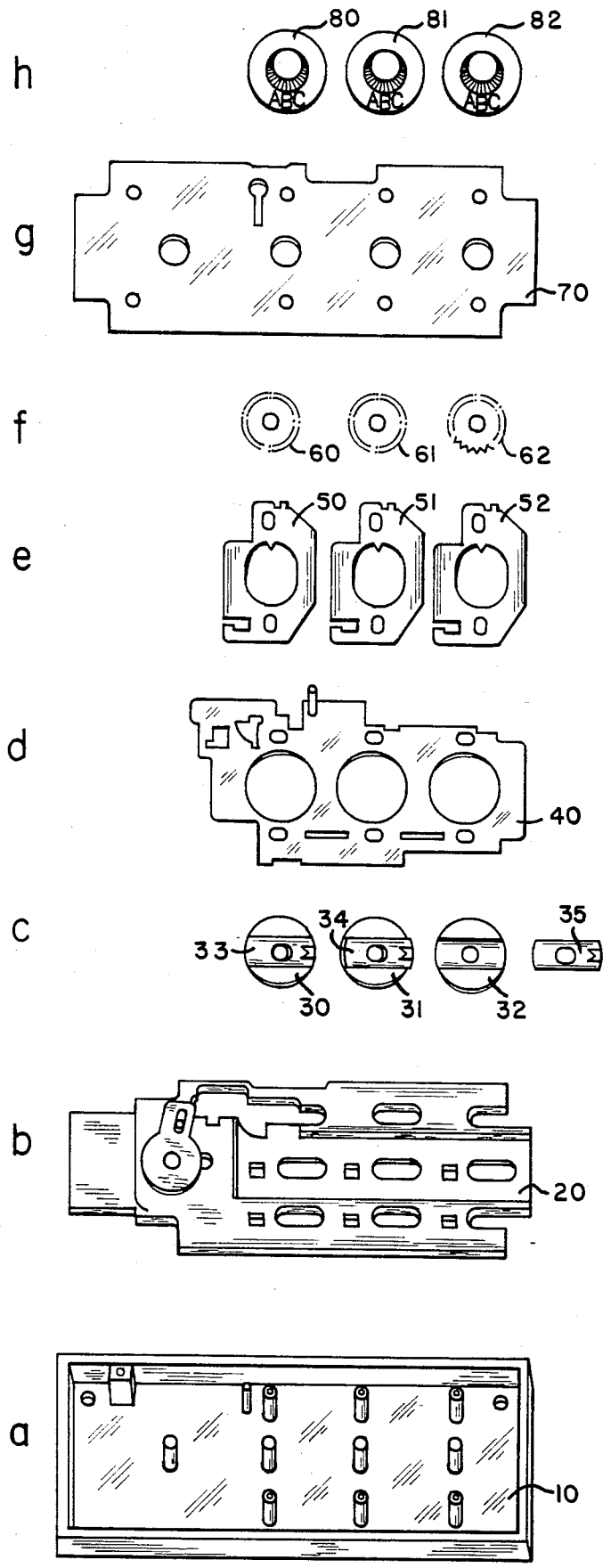
FIG. 1 is an exploded view of the essential components of the lock in accordance with the preferred embodiment of the present invention for practicing the best mode thereof.
Figure 4:
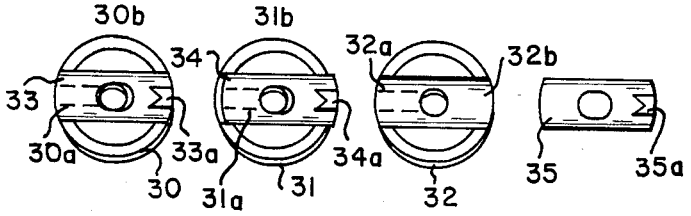
FIG. 4 illustrates three lock disks.
Figure 8:
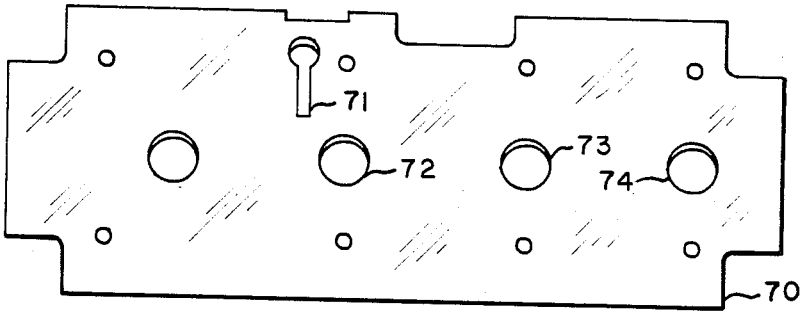
FIG. 8 illustrates a top view of the lock cover.

Proceeding now to the detailed description of the drawings, reference is made first to FIG. 1. The exploded view has been, for ease of reference, identified additionally through the levels A, B, C, D, E, F, G and H. Herein then the level A illustrates the lock box 10 or casing shown in greater detail in FIG. 2. The level B in FIG. 1 illustrates the latch plate 20 shown in greater detail in FIG. 3. The level C in FIG. 1 illustrates the three lock disks 30, 31 and 32, respectively, associated with locking slides 33, 34 and 35. The FIG. 4 illustrates this assembly in greater detail. The level D in FIG. 1 illustrates the encoding release slide 40, shown in greater detail in FIG. 5. The level E in FIG. 1 shows the three tumbler devices 50, 51 and 52, details thereof are shown in FIG. 6. The level F in FIG. 1 shows three gear disks 60, 61 and 62, repeated in FIG. 7. The level G in FIG. 1 shows a lock cover 70, shown in greater detail in FIG. 8, and the level H in FIG. 1 finally illustrates the three encoding buttons 80, 81 and 82, also shown in FIG. 9. It can thus be seen that these parts shown in exploded view in FIG. 1 are assembled in that the box or container 10 contains the parts shown in levels B through F; the container or case is then closed by the cover 70, and the encoding buttons (level H) project from that cover. This casing or box or container is then affixed to the strongbox, safe, or the like, particularly the door thereof, and cooperates with a fixed member in which the latch part of latch plate 20 is inserted for closing the strongbox.

Figure 2:
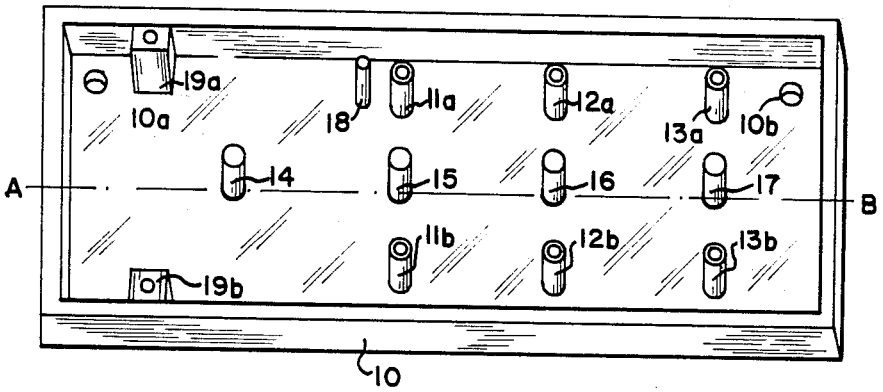
FIG. 2 is a perspective view from the top of the lock box or casing.

Turning now to FIG. 2, there is illustrated the lock box, case, or container 10 which is preferably made by means of pressure casting. The bottom of the lock box is provided with pairs of guide pins 11*a*, 11*b*; 12*a*, 12*b*; 13*a*, 13*b*; and each of these pins is provided with a threaded bore. These pins are arranged in a symmetrical relation, as can be seen with regard to an axes A-B. Certain additional pins extend upwardly from the bottom of casing 10. They are designated by reference numerals 14, 15, 16 and 17. They are guide posts or pins for the latch actuating handle, as well as for the encoding buttons 80, 81 and 82.

Reference numeral 18 in FIG. 2 denotes a guide post for the code exchange key, and two blocklike elements 19*a* and 19*b* are provided on opposite long side walls of the casing 10, and they are provided with threaded bores for receiving fastening screws. Moreover, the four corners of the bottom of the casing 10 are provided each with a fastening bore, the two bores 10*a* and 10*b* can be seen directly; the two other bores are hidden behind the lower long front wall of the case.

Figure 3:
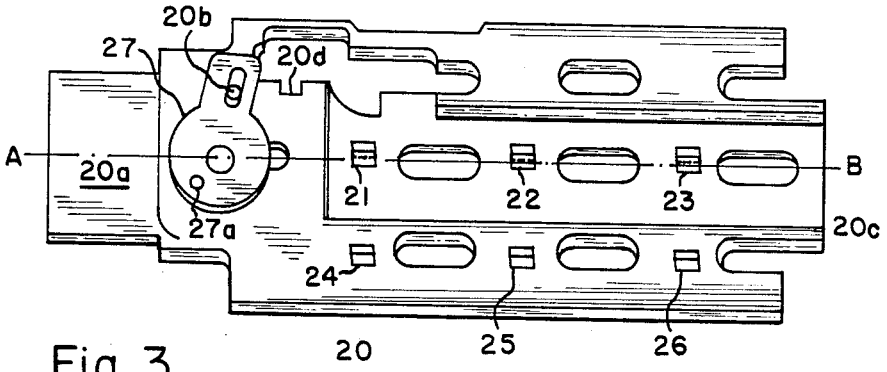
FIG. 3 is a perspective view of the latch plate.

The latch plate 20, as shown in FIG. 3, is preferably also made by a cast alloy, just as the casing 10 is made. In the left end, plate 20 carries the latch 20*a* proper. The plate 20 is provided with two series of oblong slots which are received by the pins 11*a* through 13*b*. Blocklike pins 21, 22 and 23 are arranged along the axis A-B; these are the locking pins of the lock. They engage respectively radial slots 30*a*, 31*a*, and 32*a*, respectively, of the locking disk 30, 31 and 32, as shown in FIG. 4 in the unlocked or open position of the lock. In the locked position these radial slots are misaligned so that the pins 21, 22 and 23 cannot enter them. Additional blocklike locking pins 24, 25 and 26 extending from the plate 20 in FIG. 3 engage certain slots of the tumblers as shown in FIG. 6.

An eccentric disk 27 is placed on the latch plate 20, and is mounted by means of the pin 14 as it extends from the bottom of case 10 (see FIG. 2). This disk 27 causes the latch plate 20 in its entirety to follow linearly a turning motion through the pin 20*b* as it extends from the plate 20 into an oblong slot of disk 27. The eccentric disk 27 in turn is turned through a pin 27*a* engaging a latch actuator which is not shown. Thus, on turning disk 27 via this latch actuator or handle, the arm with the slot receiving pin 20*b* shifts latch plate 20 back and forth.

In the central portion 20*c* of latch plate 20 a rectangular indentation is provided which receives the locking disk 30, 31 and 32 of FIG. 4. Each of these disks is, as stated above, provided on its underside with a radial slot 30*a*, 31*a*, and 32*a*, respectively, which the pins 21, 22 and 23 engage or in which they are inserted whenever the lock is opened. The upper sides of the disks 30, 31 and 32 are provided with diametrical grooves 30*b*, 31*b* and 32*b*, respectively, which in turn receive the lock slides 33, 34 and 35. The right-hand end of each of these slides carries locking teeth, respectively denoted by reference numeral 33*a*, 34*a* and 35*a*.

Figure 5:
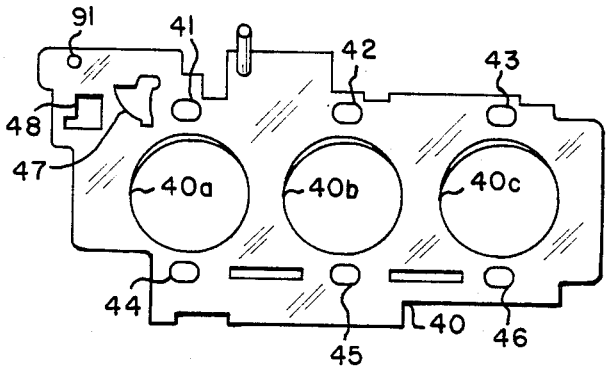
FIG. 5 illustrates a top view of an encoding release slide.
Figure 6:
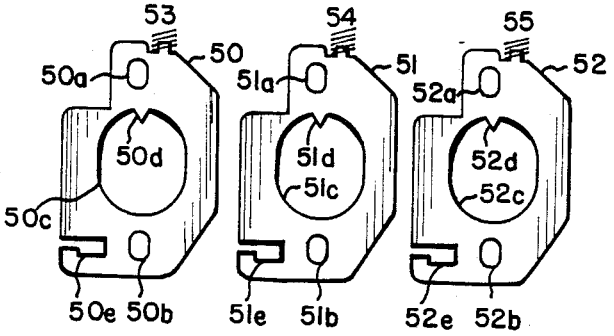
FIG. 6 illustrates three tumblers.

FIG. 5 illustrates the encode release or readjusting slide 40 having three circular and relatively large openings 40*a*, 40*b* and 40*c*. The diameter of the respective circles corresponds to the diameter of the round disks 30, 31, 32 as well as the length dimensions of the lock slides 33, 34 and 35. The slide 40, however, is disposed in such a manner above the lock disks 30, 31 and 32 so that upon adjustment of slide 40 in the direction of the axis A-B, only the lock slides 33, 34 and 35 are carried along. The slide 40 itself is guided through the aid of oblong slots 41, 42, 43, 44, 45 and 46 receiving pins 11*a* . . . 13*b*. The slide 40 is adjusted, i.e., shifted either by means of a pin 91, or through an adjusting key 90 which engages a particularly contoured slot 47.

The tumbler elements 50, 51 and 52 of FIG. 6 are respectively provided with oblong slot pairs 50*a*, 50*b*; 51*a*, 51*b*; 52*a*, 52*b*, and these slots receive the pins 11*a*, 11*b*, etc., through 13*b*. This way devices 50, 51 and 52 are guided for being shifted transversely to the axis A-B. Each device 50, 51 and 52 is provided moreover with a slightly oval indent 50*c*, 51*c*, and 52*c*, respectively, merging at the respective upper end into an inwardly extending tooth 50*d*, 51*d*, and 52*d*, respectively. Each of the tumblers 50, 51 and 52 is additionally provided with a particularly contoured slot 50*e*, 51*e*, 52*e*. Each of these slots has a narrow entrance portion and a somewhat wider interior portion. They are provided for respectively receiving the pins 24, 25 and 26, whereby a pin, such as 24, etc., when in the narrow slot portion prevents the respective tumbler from moving in a direction transversely to the axis A-B. While on the other hand, the pins 24, etc., when received by the wider portion of the slot such as 50*e*, etc., are permitted to undergo limited motion transversely to the axis A-B which is a direction of the oblong contour of an opening such as 50*a*, etc.

Figure 9:
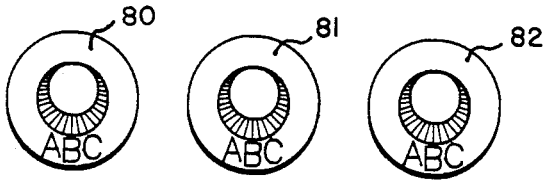
FIG. 9 is a top view of the three encoding buttons shown in alignment with the gears of FIG. 7.
Figure 7:
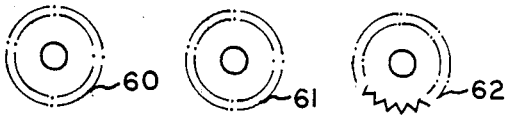
FIG. 7 illustrates somewhat schematically three gears in alignment with the tumblers of FIG. 6.

FIG. 7 merely shows for purposes of completion the three gear disks 60, 61 and 62, which through not illustrated hollow shafts are connected to the encoding buttons 80, 81 and 82, as shown in FIG. 9. These hollow shafts project through openings 72, 73, 74 in the lock cover 70. The hollow shafts receive the guide posts 15, 16 and 17 as projecting from the bottom of the case 10. The heights of the various parts are adjusted so that the gearing of the disks 60, 61 and 62 engages the locking teeth 33*a*, 34*a*, and 35*a*, respectively, as well as the single tooth 50*d*, 51*d*, and 52*d*, respectively. The devices 50, 51 and 52 are held in engagement with the teeth of gear disk 60, 61 and 62, respectively, through coil springs 53, 54 and 55, as shown in FIG. 6.

After having described the various components under due consideration of the aligned illustration of FIGS. 2 through 9, we now turn to FIG. 10, which illustrates a top view of a partially assembled lock. The latch 20*a* is assumed in this figure to have been advanced to a locking position. Underneath latch plate 20 is provided an indent slide 83, which is movable transversely to the axis A-B. This slide 83 ensures that the latch will assume only one of two positions, and in a stable configuration. This stability is attained through a coil spring 84, a pin 85, and a curved cam portion 28 of the latch plate 20.

A control slide 86, also shown in FIGS. 14, 15 and 16, is actuated through the key bit 90*a* of an adjusting key 90. This slide 86 carries a blocklike locking pin 88 and is held through a coil spring 89 in the illustrated, normal position. In this position slide 40 as well as control slide 86 are mutually blocked because the pin 88 abuts the latch plate 20. In other words, the spring 89 pushes the slide 86 in a direction which is up in FIG. 10. The upper edge of latch plate 20 holds the pin 88 against the upper edge of the slot 48. Release from this position is possible only if through lateral shifting of latch plate 20 the cutout 20*d* is brought into alignment with the pin 88 so that the pin 88 can enter that cutout.

FIG. 11 illustrates the position of assembled parts in accordance with FIG. 10. One can see the slides 83 and 86 as being disposed between the bottom of the casing 10 and the latch plate 20. One can also see the key 90. In the illustrated closing position or locking position, pins 21, 22 and 23 are respectively disengaged from the locking disks 30, 31 and 32. Thus, turning of these disks permits misalignment of their radial slots with respect to the pins. Moreover, the locking pin 24 does not engage slot 50*e* of device 50 (the situation is similar with regard to pins 25, 26 and slots 51*e*, 52*e*). It is thus apparent that in the locking position the encoding buttons 80, 81 and 82 can be freely adjusted to thereby destroy the original combination setting in which slots 30*a*, etc., were aligned with pins 21, etc., and to establish randomly a new one. If one were to attempt at that point to slide the latch 20*a* back, pins 21, 22 and 23 will abut the periphery locking disk 30, 31 and 32, respectively. After the proper combination has been restored in buttons 80, etc., the locking slides 33, 34 and 35, and disks 30, 31, 32, return to the disposition shown in FIG. 4, and now the latch can in fact be opened (pivoting of disk 27) because the radial slots of the disk 30, 31, 32 are again aligned with the pins 21, 22, 23, respectively.

Only in an open position of the lock corresponding to FIGS. 12 and 13 is it possible to actually change the combination. In this position, locking pin 88 faces the cutout of recess 20*d* of the latch plate 20, and upon shifting slide 86, pin 88 links recess 20*d* and blocks latch slide 20 so that the latch is in fact blocked during the adjusting towards a new combination setting. Moreover, the locking disks 30, 31 and 32 are blocked and held against rotation in the open position via the pins 21, 22 and 23, while on the other hand, through the locking key 33*a*, 34*a* and 35*a* the gears 60, 61, 62 are blocked to thereby block the encoding buttons. In the open position of the latch the encoding buttons are therefore in an adjusting position representing the old combination such as A, B and C, for example. In deviation from the illustrated structure, the blocking teeth 33*a*, 34*a*, and 35*a* can be replaced by mechanically stabilized locking segments.

The authorized user of the strongbox of which latch and lock is a part can change the code only after the lock is unlatched as described. In order to permit re-encoding we must first shift the control slide 86 in down direction as stated until the locking pin 88 connected with the slide 86 releases the slide 40. This release is obtained through the L-shaped configuration of the slot 48 because if upon shifting the control slide 86 the pin 88 so to speak moves down along the stem of the L, it will become aligned with the foot part of the L (compare FIGS. 12 and 13). Now slide 40 is shifted into the right-hand end position through the coil spring 93. Accordingly, the locking or blocking teeth 33*a*, 34*a*, and 35*a* disengage from the gears 60, 61, and 62, thereby releasing the encoding buttons from a position in which they are prevented from turning. As long as the teeth 33*a*, 34*a*, and 35*a* engage these gears, they cannot be turned as long as the pins 21, 22, and 23 are in the radial slots of the disks 30, 31, and 32, which is the case when the lock is open. Now the slide 40 has in fact interrupted the connection between the encoding button and the locking disks 30, etc. Accordingly, these buttons can be set to a new position while the disks 30, 31, and 32 are maintained in a locked open position.

The tumbler devices 50, 51 and 52, respectively through their teeth 50*d*, 51*d* and 52 impart a digitalization upon the movement of the encoding buttons. Each of these devices 50, 51 and 52 is moved up and down as the respective coding button is turned and their teeth snap back into the gearing. As can be seen by comparing FIGS. 12 and 13 with FIGS. 10, a pin such as 24 is out of the slot 50*e* of the respective tumbler such as 50. However, in the latch open position, as per FIGS. 12 and 13, this pin 24 has entered the wide portion of opening 50*e*. As now each of these tumblers 50, 51, and 52 is moved up and down during adjustment of the respective encoding button, the wise portion of these slots 50*e*, 51*e*, and 52*e* do indeed permit this limited motion of the respective tumbler. The narrow portion of each of these slots 50*e*, 51*e*, and 52*e*, however, will prevent such an up and down motion of the tumblers, which means that these tumblers can move up and down only when the latch is either completely open or closed. If during encoding one of the devices 51, 52 and 53 happen to be stopped on a tooth that is in between two encoding positions, then latch motion is in fact blocked through the respective control slot. Conversely, as stated the encoding buttons cannot be adjusted when the latch remains in an in-between position; the tumblers will prevent it. Thus, the digitalization imparts upon the system an aspect of definite and discrete positions; in-between positions are so-to-speak prohibited, and their attainment is in fact prevented. All these various interlocking features as described will render in fact the lock foolproof, because even in case of correct manipulation it will not attain a disposition or operating state in which it is locked to such an extent that only drilling, i.e., brute force is required to open.

Basically, the lock is available, or is to be made available, in two versions. Version 1 will be used for long-term users, i.e., in banks or in homes where the user in fact doesn't change. Version 2 will be employed in case the user changes, i.e, for example in hotels where the same strongbox or room safe will be assigned to different guests at different times. These aspects are realized as follows: In version 1 the control slide 86 is moved through the pin 92 as shown in FIG. 16, which is fastened to the rear of the slide 86 and reaches through the lock casing into the strongbox itself. Another pin 91 which also projects from the rear of the lock casing is connected to the slide 40. The respective positions of the slides 40 and 86 are shown in FIGS. 12 and 13.

As stated, the cutout 48 has an L-shaped or angular contour, which in turn causes the control slide 86 to be blocked whenever the slide 40 assumes the position for changing the combination. The slide 40 carries the lock slides 33, 34 and 35 through the cutout 40*a*, 40*b* and 40*c* such that the gears 60, 61 and 62 are decoupled and disengage the locking teeth 33*a*, 34*a* and 35*a*. Consequently the encoding buttons 80, 81 and 82 can now be readjusted to change from the old combination, such as A, B and C, to a new one, such as X, Y and Z. If one now returns the slide 40 (to the left) through the pin 91, spring 89 forces the control slide 86 in upward direction, and the slide 40 is again blocked. For example, one may now inspect the device and, for example, through a trial run with open door of the strongbox, the latch can be advanced (FIG. 10) and one may see whether or not the adjustment was properly made, whereupon the box can be properly closed and the combination "destroyed", i.e., the buttons will not be adjusted to a random position.

Version 2 is as stated to be used, for example, in hotels, which of course poses a particular and special conditions. For example, the user, such as guest in a hotel, should be in a position to adjust a particular combination without anybody knowing it, including any of the hotel personnel. On the other hand, it must be made sure that after the guests has departed, the container or room safe is in fact unlatched, otherwise a very extensive search may ensue, and the container or box is in fact unusable for a long period of time. If the whereabouts of a guest remains unknown, or if the guest has in fact forgotten the combination which he has adjusted, it seem that the only possibility is to partially destroy the lock in order to open the strongbox. However, in order to avoid these problems, the lock in this hotel version is used without the pins 91 and 92 being provided, and instead it comes with a key 90. Only in case of an open latch and in the release position of slide 40, can the key be inserted into the keyhole 71 or withdrawn therefrom! Thus, it is incumbent upon the hotel personnel to demand the key from the guest when he departs. This way the strongbox is open with certainty and the buttons are not locked to the previous encoding position. The lock can indeed be re-encoded by the next user of the same room and the strongbox.

The key 90 is inserted into the key bit cutout 87 of the slide 86, as well as in the corresponding cutout 47 of the slide 40. FIG. 14 illustrates the normal position (key not removable); FIG. 15 the encoding position (key can be inserted and removed). Since the keyhold 71 (FIG. 8) is arranged transversely to the axis A-B of the lock, the key 90 can indeed be removed only from the re-encoding position as per FIG. 15. In this position, however, latch 20*a* is blocked. This means that the container can be opened or closed only when the key 90 is inserted, and has the position as shown in FIG. 14. This particular solution has the significant advantage that the hotel personnel, for example, in the reception, is sure that the lock is unlocked when the guest returns the key.

Of course it is apparent that the two versions are to a considerable extent identical, whereby all parts which are made through cutting or stamping are similar. In order to avoid manipulation it is advisable, however, to provide the lock casing without oblong slots for the re-encoding pins if the lock is to be used in the hotel version for the system. Thus, no pins will be affixed to the slides 40 and 86 in this instance.

Figure 17:
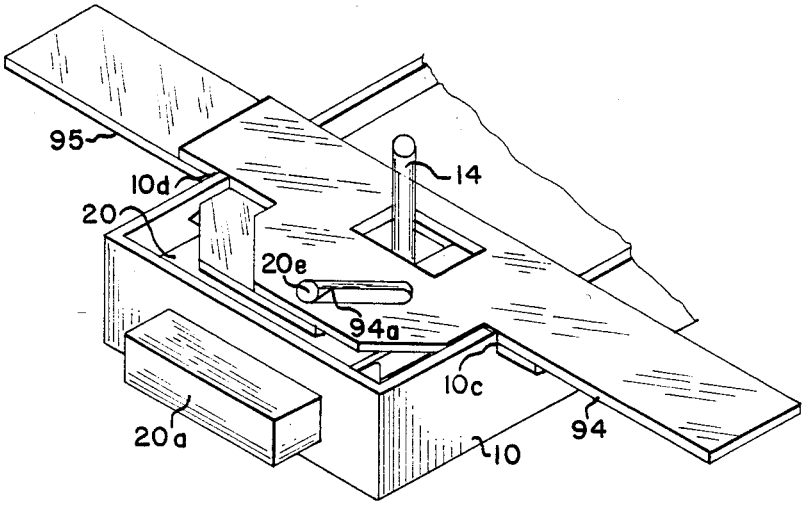
FIG. 17 illustrates a variation of the key of the lock with a particular kind of break down rod.

FIG. 17 illustrates a special version of the so-called breakdown or lifter action type. In this case the side walls of the lock casing 10 are provided with cutouts 10*c* and 10*d* in which rods 94 and 95 are guided. They are moved through obliquely positioned oblong slots, such as 94*a*, by means of a driver pin 20*e* mounted on the latch plate 20. Since the latch plate 20 is adjusted through a special handle under utilization of the guide pin 14, no problem arises, contrary to single button combination locks to transfer this supplemental torque.

Figure 18:
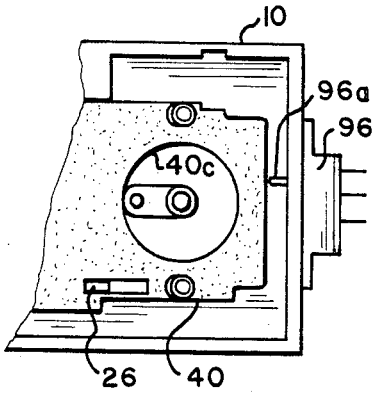
FIG. 18 is a modification or, better, supplement under utilization of a microswitch.

A supplemental version of the lock is shown in FIG. 18. In the right-hand portion of the casing 10 a microswitch 96 is mounted to the front wall facing away from the latch. The plunger 96*a* of this microswitch scans the rear edge of the slide 40. In this version then a contact is actuated whenever the slide is in the re-encoding position, i.e., when the strongbox door is opened. Therefore, in this hotel version of the lock the disposition of the lock can be signalled to a remote place such as a special indicator in the hotel reception in order to make sure that the door of the lock is open when the guest departs.

The two versions can be operated in accordance with the following operating instructions: The opening of the lock is carried out through adjusting the encoding buttons to the preselected combination and the latch handle is turned to the right. For locking, this handle is turned to the left, and the combination is destroyed through random positioning of the encoding buttons. In order to adjust the device to a new combination, version 1 requires that the control slide pin 92 is shifted down so that the re-encoding slide 40 is released for releasing the encoding buttons so that indeed a new combination can be selected. Having done that, the slide 40 is shifted back by means of the pin 91.

Version 2 for the hotel use requires the utilization of key 90, which is tunred by 90 degrees in order to release again the slide 40. Now the new combination is adjusted and the key is turned to the right, but cannot be withdrawn. In the changing position, i.e., in that position in which a new combination can be adjusted while the lock is in fact open, the key can be released to be handed to the receptionist for reuse by the next guest.

It is customary to provide 26 adjusting positions on the encoding buttons, for example, for the letters of the alphabet. This means that with three encoding buttons one obtains $26^3$, i.e., 17,576 combinations. If one uses four combination buttons, one obtains 456,976 combinations. If one adds the digits 1 through 9 to the 26 letters of the alphabet, three encoding buttons permit 42,875 combinations. Of course another possibility for increasing safety through increase in the number of combinations is to provide two locks with separate encodings in a door. It is believed, however, that for practical purposes the three adjusting button versions $26^3$ combinations constitutes a best mode of realizing the invention.

Other important aspects in the realization are to be seen in that at least the casing, the latch plate, the locking disks, the locking slides, and the encoding buttons are made through pressure casting. The flat part, such as the slide 40 and the devices 50, 51 and 52, are preferably punched out part under utilization of sheet metal.

The new combination lock is quite economical to make, very simple to operate, and quite safe. The changes in combinations can be carried out by unskilled users such as hotel guests in a few seconds even through they are not familiar with the construction in a few seconds. Thus, contrary to the single axle combination locks, this version is quite suitable for broad use in hotels, banks or the like. The decisive advantage of this lock, however, is that owing to the internal locking and latching mechanism, it is impossible to open the lock simply through fine feel scanning.

The invention is not limited to the embodiments described above, but all changes and modifications thereof not constituting departures from the spirit and scope of the invention are intended to be included.

I claim:

1. Combination lock with encoding buttons extending from a lock case comprising:

a latch plate slidably mounted in said case and movable between two terminal positions, the latch plate having a plurality of locking pins;

an adjustable encoding release slide;

a plurality of lock disks each having on one side a radial groove for resepctively engaging the locking pins or being disengaged therefrom, each disk further having on its other side a diametrical groove in which respective slide locks are permitted to slide, there being means in the encoding release slide for moving said slide locks;

a plurality of gears respectively connected to said encoding buttons and positioned for engagement with said slide locks, said gears being prevented from turning, thereby preventing the encoding buttons from being turned when the respective slide lock engages the gear and the locking pins are situated in the respective radial grooves, the gears being coupled to the lock disks when the locking pins are out of the respective radial grooves, said release slide when moving said slide locks decoupling the lock disks from the gears and the encoding button; and resiliently biased tumblers associated with said gears such that the gears are releasable only in the end positions of said latch plate.

2. Combination lock as in claim 1 wherein said adjustable encoding release slide and said latch plate are movable in parallel directions, said tumblers being positioned for resilient replacement in an orthogonal direction.

3. Combination lock as in claim 1, said latch plate having additional locking pins cooperating with control slots in said tumblers to permit their release only in the terminal positions of said latch plate.

4. Combination lock as in claim 1, there being guide pins in said case for guiding slide movement of said release slide and of said latch plate.

5. Combination lock as in claim 1 and including a control slide movable in a direction transverse to a direction of movement of said latch plate, said control slide carrying a lock pin cooperating with said release slide and said latch plate such that actuation of said latch plate is prevented when said encoding release slide has a disposition in which said slide locks are decoupled from said gears.

6. Combination lock as in claim 1 and having a cover with a keyhole for insertion of a key, said key provided for shifting said release slide, said key being removable only when said release slide is in the release position in which said slide locks are decoupled from said gear and said locking pins are inserted in said radial grooves.

7. Combination lock as in claim 1, said adjustable encoding release slide being spring biased tending to pull the release slide into the release position.

8. Combination lock as in claim 1, there being manual operable means connected or connectable to said release slide for shifting the slide between its positions, there being an additional control slide for blocking the latch plate when the release slide is in the release position, said control slide being manually operable.

9. Combination lock as in claim 1 and including electric sensing means for monitoring the disposition of said release slide.

10. Combination lock as in claim 1 including an actuator pin on said latch plate cooperating with two bars movable in opposite directions to each other and transversely to the direction of movement of said latch plate, there being oblique slots in said bar for engagement by said actuator pin.

* * * * *